US011261693B2

(12) United States Patent
Pelto et al.

(10) Patent No.: US 11,261,693 B2
(45) Date of Patent: Mar. 1, 2022

(54) COMPOSITE EXPANDABLE METAL ELEMENTS WITH REINFORCEMENT

(71) Applicant: Halliburton Energy Services, Inc., Houston, TX (US)

(72) Inventors: Christopher Michael Pelto, Garland, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 98 days.

(21) Appl. No.: 16/513,438

(22) Filed: Jul. 16, 2019

(65) Prior Publication Data

US 2021/0017835 A1 Jan. 21, 2021

(51) Int. Cl.
*E21B 33/134* (2006.01)
*E21B 33/12* (2006.01)

(52) U.S. Cl.
CPC ..... *E21B 33/134* (2013.01); *E21B 33/1212* (2013.01); *E21B 2200/01* (2020.05)

(58) Field of Classification Search
CPC . E21B 33/1208; E21B 33/1212; E21B 33/134
See application file for complete search history.

(56) References Cited

U.S. PATENT DOCUMENTS 3,046,601 A 7/1962 Hubbert et al.
4,445,694 A 5/1984 Flaherty
4,846,278 A 7/1989 Robbins
6,098,717 A 8/2000 Bailey et al.
6,640,893 B1 11/2003 Rummel et al.
6,695,061 B2 2/2004 Fripp et al.
7,040,404 B2 5/2006 Brothers et al.
7,543,639 B2 6/2009 Emerson
7,562,704 B2 7/2009 Wood et al.
7,578,347 B2 8/2009 Bosma et al.
7,909,110 B2 3/2011 Sharma et al.
7,931,079 B2 4/2011 Nicholson
8,083,000 B2 12/2011 Nutley et al.
(Continued)

FOREIGN PATENT DOCUMENTS

CA 3085547 A1 8/2019
EP 2217790 B1 10/2016
(Continued)

OTHER PUBLICATIONS

International Search Report and Written Opinion dated Aug. 2, 2018, International PCT Application No. PCT/US2017/061307.
(Continued)

*Primary Examiner* — Catherine Loikith
(74) *Attorney, Agent, or Firm* — McGuireWoods LLP

(57) ABSTRACT

Methods for forming a seal in a wellbore. An example method includes positioning an expandable metal sealing element in the wellbore; wherein the expandable metal sealing element comprises a composite material of expandable metal and a reinforcement material. The expandable metal forms a matrix and the reinforcement material is distributed within the matrix. The method further includes contacting the expandable metal sealing element with a fluid that reacts with the expandable metal to produce a reaction product having a volume greater than the expandable metal.

20 Claims, 7 Drawing Sheets

(56) References Cited

U.S. PATENT DOCUMENTS

| | | | | |
|---|---|---|---|---|
| 8,235,075 | B2 | 8/2012 | Saltel | |
| 8,240,377 | B2 | 8/2012 | Kulakofsky et al. | |
| 8,434,571 | B2 | 5/2013 | Kannan et al. | |
| 8,443,881 | B2 | 5/2013 | Thomson et al. | |
| 8,490,707 | B2 * | 7/2013 | Robisson | E21B 33/1208 166/387 |
| 8,499,843 | B2 | 8/2013 | Patel et al. | |
| 8,776,899 | B2 * | 7/2014 | Fripp | E21B 43/106 166/386 |
| 8,955,606 | B2 * | 2/2015 | O'Malley | E21B 43/103 166/386 |
| 9,133,683 | B2 | 9/2015 | Dyer et al. | |
| 9,394,757 | B2 * | 7/2016 | Lowry | E21B 33/13 |
| 9,518,453 | B2 | 12/2016 | Dilber et al. | |
| 9,725,979 | B2 | 8/2017 | Mazyar et al. | |
| 9,745,451 | B2 | 8/2017 | Zhao et al. | |
| 9,856,710 | B2 | 1/2018 | Zhu et al. | |
| 10,851,615 | B2 | 12/2020 | Watson et al. | |
| 10,961,804 | B1 * | 3/2021 | Fripp | E21B 33/1212 |
| 2003/0150614 | A1 | 8/2003 | Brown et al. | |
| 2004/0149418 | A1 | 8/2004 | Bosma et al. | |
| 2005/0092485 | A1 | 5/2005 | Brezinski | |
| 2005/0171248 | A1 | 8/2005 | Li et al. | |
| 2005/0199401 | A1 | 9/2005 | Patel et al. | |
| 2006/0144591 | A1 * | 7/2006 | Gonzalez | E21B 33/13 166/277 |
| 2007/0089911 | A1 | 4/2007 | Moyes | |
| 2007/0095532 | A1 | 5/2007 | Head et al. | |
| 2007/0200299 | A1 * | 8/2007 | Kunz | F16J 15/56 277/511 |
| 2008/0066931 | A1 | 3/2008 | Xu | |
| 2008/0142214 | A1 | 6/2008 | Keller | |
| 2008/0149351 | A1 | 6/2008 | Marya et al. | |
| 2008/0185158 | A1 | 8/2008 | Chalker et al. | |
| 2009/0020286 | A1 | 1/2009 | Johnson | |
| 2009/0179383 | A1 | 7/2009 | Koloy et al. | |
| 2009/0188569 | A1 | 7/2009 | Saltel | |
| 2009/0242189 | A1 | 10/2009 | Vaidya et al. | |
| 2009/0272546 | A1 | 11/2009 | Nutley et al. | |
| 2010/0038074 | A1 | 2/2010 | Patel | |
| 2010/0270031 | A1 | 10/2010 | Patel | |
| 2011/0073310 | A1 | 3/2011 | Clemens | |
| 2011/0226374 | A1 | 9/2011 | Kalman | |
| 2011/0253393 | A1 | 10/2011 | Vaidya et al. | |
| 2012/0073834 | A1 | 3/2012 | Lembcke | |
| 2012/0132427 | A1 | 5/2012 | Renshaw et al. | |
| 2012/0175134 | A1 | 7/2012 | Robisson et al. | |
| 2012/0205092 | A1 | 8/2012 | Givens et al. | |
| 2012/0272546 | A1 | 11/2012 | Tsai | |
| 2012/0292013 | A1 | 11/2012 | Munshi et al. | |
| 2013/0056196 | A1 | 3/2013 | Hench | |
| 2013/0146312 | A1 | 6/2013 | Gerrard et al. | |
| 2014/0051612 | A1 | 2/2014 | Mazyar et al. | |
| 2014/0054047 | A1 | 2/2014 | Zhou | |
| 2014/0060815 | A1 | 3/2014 | Wang et al. | |
| 2014/0238692 | A1 | 8/2014 | Watson | |
| 2014/0251641 | A1 | 9/2014 | Marya et al. | |
| 2014/0262351 | A1 | 9/2014 | Derby | |
| 2014/0361497 | A1 | 12/2014 | Porta | |
| 2015/0101813 | A1 | 4/2015 | Zhao et al. | |
| 2015/0199401 | A1 | 7/2015 | Polehn et al. | |
| 2015/0267501 | A1 * | 9/2015 | Al-Gouhi | E21B 33/12 166/299 |
| 2016/0032696 | A1 | 2/2016 | Caccialupi et al. | |
| 2016/0137912 | A1 | 5/2016 | Sherman et al. | |
| 2016/0138359 | A1 | 5/2016 | Zhao et al. | |
| 2016/0194933 | A1 | 7/2016 | O'Brien et al. | |
| 2016/0201425 | A1 | 7/2016 | Walton et al. | |
| 2016/0215604 | A1 | 7/2016 | Potapenko | |
| 2016/0230495 | A1 | 8/2016 | Mazyar et al. | |
| 2016/0319633 | A1 | 11/2016 | Cooper et al. | |
| 2016/0376869 | A1 * | 12/2016 | Rochen | E21B 29/02 166/135 |
| 2016/0376870 | A1 | 12/2016 | Roselier et al. | |
| 2017/0122062 | A1 | 5/2017 | Freyer | |
| 2017/0356269 | A1 * | 12/2017 | Denton | E21B 33/1208 |
| 2018/0087346 | A1 | 3/2018 | Rochen | |
| 2018/0266215 | A1 | 9/2018 | Fagley, IV et al. | |
| 2018/0355691 | A1 | 12/2018 | Andersen | |
| 2018/0355693 | A1 | 12/2018 | Al-AbdulJabbar et al. | |
| 2019/0055839 | A1 | 2/2019 | Skillingstad et al. | |
| 2019/0203101 | A1 | 7/2019 | Dusterhoft et al. | |
| 2020/0240235 | A1 | 7/2020 | Fripp et al. | |
| 2020/0325749 | A1 | 10/2020 | Fripp et al. | |
| 2020/0370391 | A1 * | 11/2020 | Fripp | E21B 33/1277 |
| 2021/0032980 | A1 * | 2/2021 | Fripp | E21B 47/06 |

FOREIGN PATENT DOCUMENTS

| | | | |
|---|---|---|---|
| EP | 2753791 | B1 | 6/2017 |
| GB | 2416796 | A | 2/2006 |
| GB | 2514195 | B | 6/2019 |
| WO | 2008079486 | A1 | 7/2008 |
| WO | 2014210283 | A1 | 12/2014 |
| WO | 2016171666 | A1 | 10/2016 |
| WO | 2018005740 | A1 | 1/2018 |
| WO | 2018057361 | A1 | 3/2018 |
| WO | 2019094044 | A1 | 5/2019 |
| WO | 2019147285 | A1 | 8/2019 |
| WO | 2019164492 | A1 | 8/2019 |
| WO | 2019164499 | A1 | 8/2019 |
| WO | 2020005252 | A1 | 1/2020 |
| WO | 2020018110 | A1 | 1/2020 |

OTHER PUBLICATIONS

Search Report in FR Application No. 1859379, dated Oct. 15, 2019.

International Search Report and Written Opinion dated Nov. 19, 2018; International PCT Application No. PCT/US2018/019337.

Denmark Examination Report and Search Report dated Mar. 16, 2021, Denmark Application No. PA202070389.

International Search Report and Written Opinion dated Jul. 8, 2020, issued in related International Application No. PCT/US2019/056814.

International Search Report and Written Opinion for corresponding PCT International Application No. PCT/US2019/068497; dated Sep. 17, 2020.

International Search report and Written Opinion for corresponding International Patent Application No. PCT/US2019/062225, dated Aug. 11, 2020.

International Search report and Written Opinion issued in related PCT/US2019/068493 dated Sep. 15, 2020.

NEMISIS Annulus Swellable Packer, Weatherford, Swellable Products, 2009-2011.

International Search Report and Written Opinion dated Nov. 22, 2019; International PCT Application No. PCT/US2019/019210.

International Search Report and Witten Opinion dated May 20, 2020, issued in related PCT/US2019/047529.

Tao, Solid expandable tubular patching technique for high-temperature and high-pressure casing damaged wells, Research Paper, Jun. 2015, pp. 408-409, Petroleum Exploration and Development, vol. 42, Issue 3.

Dutch Search Report issued in NL 2026726, dated Aug. 13, 2021.

International Search Report and Written Opinion dated Sep. 8, 2021 in PCT/US2020/066193.

Search Report and Written Opinion issued in NL2026329, dated Aug. 13, 2021.

Written Opinion and Search Report in SG Appln No. 11202000316S, dated Aug. 30, 2021.

Dutch Search Report in NL Appln No. 2026737, dated Aug. 13, 2021.

Examination Report in GCC Appln No. GC 2020-39914, dated Jul. 29, 2021.

(56) References Cited

OTHER PUBLICATIONS

Office Action in CA Appln No. 3,070,929, dated Jul. 9, 2021.
International Search Report & Written Opinion in PCT/US2019/042074 dated Apr. 10, 2020.
Search Report in NL Appln No. 2025837, dated Sep. 23, 2021.

* cited by examiner

COMPOSITE EXPANDABLE METAL ELEMENTS WITH REINFORCEMENT

TECHNICAL FIELD

The present disclosure relates to the use of expandable metals as sealing elements, and more particularly, to the use of a composite material comprising an expandable metal and a reinforcement material. The expandable metal forms a matrix with the reinforcement material distributed therein, and this composite material may be used for forming sealing elements in wellbore applications.

BACKGROUND

Sealing elements may be used for a variety of wellbore applications including forming annular seals in and around conduits in wellbore environments. Typically, sealing elements comprise swellable materials that may swell if contacted with specific swell-inducing fluids. An example of these swellable sealing elements are swell packers that may form annular seals in both open and cased wellbores. The annular seal may restrict all or a portion of fluid and/or pressure communication at the seal interface. Seal formation is an important part of wellbore operations at all stages of drilling, completion, and production.

Many species of the aforementioned swellable materials comprise elastomers. Elastomers, such as rubber, swell when contacted with a swell-inducing fluid. The swell-inducing fluid may diffuse into the elastomer where a portion may be retained within the internal structure of the elastomer. Swellable materials such as elastomers may be limited to use in specific wellbore environments, for example, those without high salinity and/or high temperatures. The present disclosure provides improved apparatus and methods for manufacturing sealing elements and for forming seals in wellbore applications.

BRIEF DESCRIPTION OF THE DRAWINGS

Illustrative examples of the present disclosure are described in detail below with reference to the attached drawing figures, which are incorporated by reference herein, and wherein.

Figure 1:
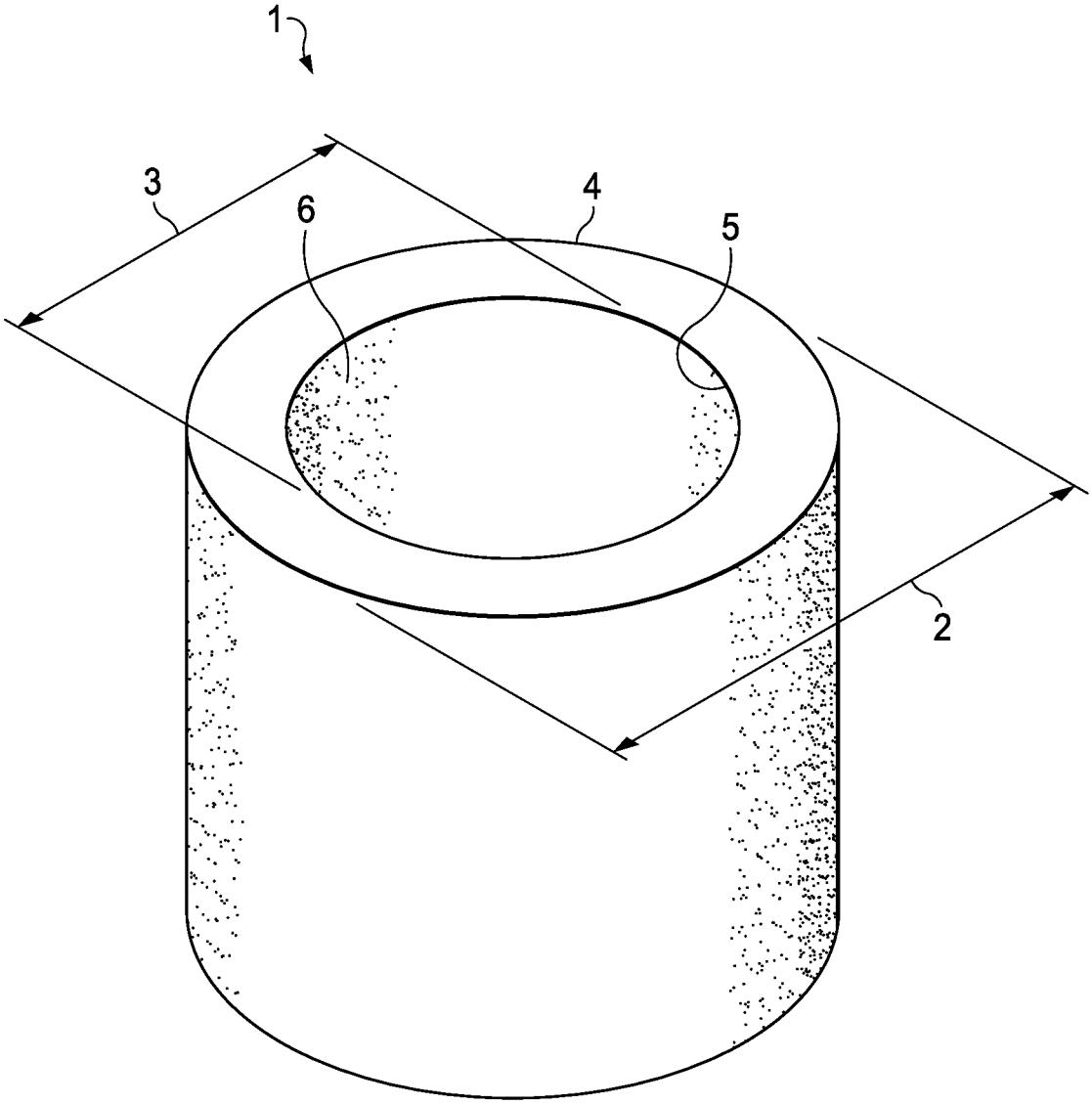
FIG. 1 is an isometric illustration of an example expandable metal sealing element in accordance with the examples disclosed herein.

The illustrated figures are only exemplary and are not intended to assert or imply any limitation with regard to the environment, architecture, design, or process in which different examples may be implemented.

DETAILED DESCRIPTION

The present disclosure relates to the use of expandable metals as sealing elements, and more particularly, to the use of a composite material comprising an expandable metal and a reinforcement material. The expandable metal forms a matrix with the reinforcement material distributed therein, and this composite material may be used for forming sealing elements in wellbore applications.

In the following detailed description of several illustrative examples, reference is made to the accompanying drawings that form a part hereof, and in which is shown by way of illustration examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems described herein relate to the use of sealing elements comprising expandable metals. As used herein, "sealing elements" refers to any element used to form a seal. The expandable metals may expand after contact in specific reaction-inducing fluids thereby creating a seal at the interface of the sealing element and any adjacent surfaces. By "expand," "expanding," or "expandable" it is meant that the sealing element increases its volume as the expandable metal reacts with a reaction-inducing fluid, such as a brine, which induces the formation of the reaction products resulting in the volumetric expansion of the sealing element as these reaction products are formed. The reaction products of the expandable metal and the reaction-inducing fluid occupy more space than the unreacted expandable metal and thus the reaction products formed therein result in an expanded sealing element, which expands outward as the reaction of the expandable metal with the reaction-inducing fluid proceeds. Advantageously, the expandable metal sealing elements may be used in a variety of wellbore applications where an irreversible seal is desired. Yet a further advantage is that the expandable metal sealing elements may swell in high-salinity and/or high-temperature environments that may be unsuitable for some other species of sealing elements. An additional advantage is that the expandable metal sealing elements comprise a wide variety of metals and metal alloys and may expand upon contact with reaction-inducing fluids, including a variety of wellbore fluids. The expandable metal sealing elements may be used as replacements for other types of sealing elements (e.g., elastomeric sealing elements), or they may be used as backups for other types of sealing elements. One other advantage is that the expandable metal sealing elements further comprise reinforcement materials distributed within a matrix of the expandable metal. A composite of the two materials is formed. The reinforcement materials improve the tensile capability of the sealing element thereby reinforcing the structure of the sealing element. Additionally, the reinforcement materials provide additional bonding/reaction surfaces for the reaction of the expandable metal with the reaction-inducing fluid.

The expandable metals swell by undergoing a reaction (e.g., a metal hydration reaction) in the presence of a reaction-inducing fluid (e.g., a brine) to form a reaction product (e.g., metal hydroxides). The resulting reaction products occupy more space relative to the base expandable metal reactant. This difference in volume allows the expandable metal sealing element to form a seal at the interface of the expandable metal sealing element and any adjacent surfaces. Magnesium may be used to illustrate the volumetric expansion of the expandable metal as it undergoes reaction with the reaction-inducing fluid. A mole of magnesium has a molar mass of 24 g/mol and a density of 1.74 g/cm$^3$ resulting in a volume of 13.8 cm$^3$/mol. Magnesium hydroxide, the reaction product of magnesium and an aqueous reaction-inducing fluid, has a molar mass of 60 g/mol and a density of 2.34 g/cm$^3$ resulting in a volume of 25.6 cm$^3$/mol. The magnesium hydroxide volume of 25.6 cm$^3$/mol is an 85% increase in volume over the 13.8 cm$^3$/mol volume of the mole of magnesium. As another example, a mole of calcium has a molar mass of 40 g/mol and a density of 1.54 g/cm$^3$ resulting in a volume of 26.0 cm$^3$/mol. Calcium hydroxide, the reaction product of calcium and an aqueous reaction-inducing fluid, has a molar mass of 76 g/mol and a density of 2.21 g/cm$^3$ resulting in a volume of 34.4 cm$^3$/mol. The calcium hydroxide volume of 34.4 cm$^3$/mol is a 32% increase in volume over the 26.0 cm$^3$/mol volume of the mole of calcium. As yet another example, a mole of aluminum has a molar mass of 27 g/mol and a density of 2.7 g/cm$^3$ resulting in a volume of 10.0 cm$^3$/mol. Aluminum hydroxide, the reaction product of aluminum and an aqueous reaction-inducing fluid, has a molar mass of 63 g/mol and a density of 2.42 g/cm$^3$ resulting in a volume of 26 cm$^3$/mol. The aluminum hydroxide volume of 26 cm$^3$/mol is a 160% increase in volume over the 10 cm$^3$/mol volume of the mole of aluminum. The expandable metal may comprise any metal or metal alloy that undergoes a reaction to form a reaction product having a greater volume than the base expandable metal or alloy reactant.

Examples of suitable metals for the expandable metal include, but are not limited to, magnesium, calcium, aluminum, tin, zinc, beryllium, barium, manganese, or any combination thereof. Preferred metals include magnesium, calcium, and aluminum.

Examples of suitable metal alloys for the expandable metal include, but are not limited to, alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increases hydroxide formation. Examples of dopant metals include, but are not limited to nickel, iron, copper, carbon, titanium, gallium, mercury, cobalt, iridium, gold, palladium, or any combination thereof.

In some examples, the expandable metal comprises an oxide. As an example, calcium oxide reacts with water in an energetic reaction to produce calcium hydroxide. One mole of calcium oxide occupies 9.5 cm$^3$ whereas one mole of calcium hydroxide occupies 34.4 cm$^3$. This is a 260% volumetric expansion of the mole of calcium oxide relative to the mole of calcium hydroxide. Examples of metal oxides suitable for the expandable metal may include, but are not limited to, oxides of any metals disclosed herein, including magnesium, calcium, aluminum, iron, nickel, copper, chromium, tin, zinc, lead, beryllium, barium, gallium, indium, bismuth, titanium, manganese, cobalt, or any combination thereof.

It is to be understood, that the selected expandable metal is chosen such that the formed sealing element does not dissolve or otherwise degrade in the reaction-inducing fluid. As such, the use of metals or metal alloys for the expandable metal that form relatively insoluble reaction products in the reaction-inducing fluid may be preferred. As an example, magnesium hydroxide and calcium hydroxide reaction products have low solubility in water. As an alternative, or in addition to, the expandable metal sealing element may be positioned and configured in a way that constrains degradation of the sealing element in the reaction-inducing fluid due to the geometry of the area in which the sealing element is disposed. This may result in reduced exposure of the expandable metal sealing element to the reaction-inducing fluid, but may also reduce degradation of the reaction product of the expandable metal sealing element, thereby prolonging the life of the formed seal. As an example, the volume of the area in which the sealing element is disposed may be less than the potential expansion volume of the volume of expandable metal disposed in said area. In some examples, this volume of area may be less than as much as 50% of the expansion volume of expandable metal. Alternatively, this volume of area may be less than 90% of the expansion volume of expandable metal. As another alterative, this volume of area may be less than 80% of the expansion volume of expandable metal. As another alterative, this volume of area may be less than 70% of the expansion volume of expandable metal. As another alterative, this volume of area may be less than 60% of the expansion volume of expandable metal.

In some examples, the formed reaction products of the expandable metal reaction may be dehydrated under sufficient pressure. For example, if a metal hydroxide is under sufficient contact pressure and resists further movement from the additional formation of hydroxide because of the geometry of the area in which the expandable metal sealing element is disposed, the elevated pressure may induce dehydration of the metal hydroxide to form the metal oxide. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the expanded metal may allow for the formation of additional metal hydroxide in some circumstances in which the metal hydroxide may be reformed, or the dehydration allows provides additional available volume for the continued reaction of the base metal reactant and the reaction-inducing fluid.

The expandable metal sealing element may be formed from the compression of discrete pieces of the expandable metal having the reinforcement material distributed therein. The expandable metal may be provided as discrete pieces for use in the preparation of the sealing element. The discrete pieces may be prepared by any sufficient method. The discrete pieces may be any shape and size. Examples of the discrete pieces include, but are not limited to powders, slivers, chips, chunks, cuttings, or any combination thereof. One method for the preparation of the discrete pieces of the expandable method is cutting. A solid piece of the expandable metal may be cut by a sharp and/or abrasive material into discrete pieces of a desired size and shape. Other methods of producing the discrete pieces of the expandable metal include grinding, sawing, sanding, lapping, and the like. The discrete pieces should be of a sufficient size and shape to be dispersed in a compressible mold without the formation of voids or channels in the resulting compacted sealing element. The discrete pieces should be of a sufficient size and shape to form a matrix of expandable metal in a compressible mold such that the reinforcement materials are able to be distributed in said matrix in the resulting compacted sealing element.

The reinforcement material may be distributed within the matrix of the discrete pieces of the expandable metal in the sealing element. The discrete pieces of the expandable metal and the reinforcement material may be placed into a mold and then compressed into a desired shape to form the expandable metal sealing element. The reinforcement material may be any material that improves the tensile capabilities of the sealing element. Examples of the reinforcement material include, but are not limited to, metals, ceramics, glass, plastics, and any combination thereof. In some examples, metals may be preferred. Examples of metal reinforcement materials may include, but are not limited to, aluminum, steel, and any combination thereof. The reinforcement materials may comprise any size sufficient for forming the sealing element. The reinforcement materials may comprise any shape including rods, balls, mesh or weaves, etc. In examples comprising a mesh or weave, the strands of the reinforcement material may be interconnected in any sufficient manner and in any pattern. Portions of the meshed or woven material may then be distributed within the matrix of the expandable metal in the compressible mold. Compaction of the expandable metal and the reinforcement material produces a composite material with improved tensile capabilities relative to the tensile capabilities of the base expandable metal.

The preparation of the sealing element comprises providing discrete pieces of the expandable metal to a compressible mold. The discrete pieces may be prepared as described above and may be any shape and size so long as they are able to fit within and able to be compacted in the mold. The reinforcement materials are distributed within the matrix of the discrete pieces of expandable metal within the mold. The reinforcement materials may be any shape and size so long as they are able to fit within and able to be compacted in the mold. The reinforcement materials may be distributed within the expandable metal matrix in any desired distribution. In some examples, the reinforcement materials may have a uniform distribution within the expandable metal matrix. This may be achieved through the uniform placement of the reinforcement materials within the mold. Alternatively, the reinforcement materials may be dry blended with the discrete pieces of the expandable metal before placement in the mold. In an uneven distribution, the reinforcement materials may be concentrated in a specific area of the expandable metal sealing element. For example, with a torus-like sealing element having a doughnut or ring shape, the reinforcement materials may be concentrated towards the interior of the sealing element approaching the axis. Alternatively, the reinforcement materials may be concentrated radially outwards from the interior of the sealing element near the exterior surfaces of the outer circumference of the sealing element. If the sealing element is a v-ring, the reinforcement materials may be differentially distributed in the v-shape to add more or less structural support to different areas of the v-shape. For example, the outer edges of the v-shape may contain more reinforcement materials than the interior groove of the v-shape or vice versa. If the sealing element is a disc, the reinforcement materials may be differentially distributed to add more or less structural support to the interior or exterior of the disc, or to one half of the disc relative to the other. After the discrete pieces of the expandable metal and the reinforcement materials are placed in the mold, pressure may be applied to the mold to compact the discrete pieces of the expandable metal and the reinforcement materials together, fusing them to form a composite material in the desired shape of the sealing element.

In some optional examples, the mold may include a section that will form a hollow opening upon compaction, and this hollow opening will form a feed-through in the produced sealing element. Alternatively, a conduit or other such hollow tube may be placed in the mold along with the discrete pieces of expandable metal and reinforcement materials. This conduit may be positioned such that after compaction, the hollow tube forms a feed-through in the produced sealing element. The feed-though may be used to feed electrical wiring, lines, and other materials through the body of the sealing element. In some examples, the feed-through may comprise a fitting that selectively seals the feed-through from fluids while allowing passage of other materials such as electrical wiring. The fitting may couple components on either side of the sealing element in some examples.

In some optional examples, the expandable metal sealing element may include a bonding agent. The bonding agent may be used to bond the discrete pieces of expandable metal together as well as to bond the discrete pieces of expandable metal to the reinforcement materials. The bonding agent may be dispersed in the mold as desired along with the discrete pieces of expandable metal and the reinforcement materials. Alternatively, the bonding agent may be blended with the discrete pieces of expandable metal and/or the reinforcement materials prior to placement in the mold. Examples of the bonding agent include, but are not limited to, any species of adhesive, epoxy, silane, acrylic, acrylate, or any combination thereof.

In some optional examples, the expandable metal sealing element may include a removable barrier coating. The removable barrier coating may be used to cover the exterior surfaces of the sealing element and prevent contact of the expandable metal with the reaction-inducing fluid. The removable barrier coating may be removed when the sealing operation is to commence. The removable barrier coating may be used to delay sealing and/or prevent premature sealing with the expandable metal sealing element. The removable barrier coating may be placed in the mold on the exterior surfaces of the mold as desired and then the discrete pieces of expandable metal and the reinforcement materials may be added to the mold. Compaction will wrap the removable barrier coating around the formed sealing element. Alternatively, the removable barrier coating may be added to the formed sealing element after it is removed from the mold. Examples of the removable barrier coating include, but are not limited to, any species of plastic shell, organic shell, paint, dissolvable coatings (e.g., solid magnesium compounds), eutectic materials, or any combination thereof. When desired, the removable barrier coating may be removed from the sealing element with any sufficient method. For example, the removable barrier coating may be removed through dissolution, a phase change induced by changing temperature, corrosion, hydrolysis, or the removable barrier coating may be time-delayed and degrade after a desired time under specific wellbore conditions.

The expandable metal sealing elements may be used to form a seal between any adjacent surfaces that are proximate the expandable metal sealing elements. Without limitation, the expandable metal sealing elements may be used to form seals on conduits, formation surfaces, cement sheaths, downhole tools, and the like. For example, an expandable metal sealing element may be used as a swell packer to form a seal between the outer diameter of a conduit and a surface of the subterranean formation. Alternatively, the swell packer may be used to form a seal between the outer diameter of a conduit and a cement sheath (e.g., a casing). As another example, the swell packer may be used to form a seal between the outer diameter of one conduit and the inner diameter of another conduit (which may be the same or a different species of conduit). Moreover, a plurality of swell packers may be used to form seals between multiple strings of conduits (e.g., oilfield tubulars). In another specific example, the expandable metal sealing elements may form a seal on the inner diameter of a conduit to restrict fluid flow through the inner diameter of a conduit, thus functioning similarly to a bridge plug. It is to be understood that the expandable metal sealing elements may be used to form a seal between any adjacent surfaces in the wellbore and this disclosure is not to be limited to the explicit examples disclosed herein. As described above, the expandable metal sealing elements comprise expandable metals and as such, they are non-elastomeric materials. As non-elastomeric materials, the expandable metal sealing elements do not possess elasticity, and therefore, they may irreversibly expand when contacted with a reaction-inducing fluid. The expandable metal sealing elements may not return to their original size or shape even after the reaction-inducing fluid is removed from contact.

Generally, the reaction-inducing fluid induces a reaction in the expandable metal to form a reaction product that occupies more space than the unreacted expandable metal. In some examples, the reaction-inducing fluid includes, but is not limited to, saltwater (e.g., water containing one or more salts dissolved therein), brine (e.g., saturated saltwater, which may be produced from subterranean formations), seawater, or any combination thereof.

Generally, the reaction-inducing fluid may be from any source provided that the fluid does not contain an excess of compounds that may undesirably affect other components in the sealing element. In the case of saltwater, brines, and seawater, the reaction-inducing fluid may comprise a monovalent salt or a divalent salt. Suitable monovalent salts may include, for example, sodium chloride salt, sodium bromide salt, potassium chloride salt, potassium bromide salt, and the like. Suitable divalent salt can include, for example, magnesium chloride salt, calcium chloride salt, calcium bromide salt, and the like. In some examples, the salinity of the reaction-inducing fluid may exceed 10%. Advantageously, the expandable metal sealing elements of the present disclosure may not be impacted by contact with high-salinity fluids. One of ordinary skill in the art, with the benefit of this disclosure, should be readily able to select a reaction-inducing fluid for inducing expansion of the expandable metal sealing elements.

The expandable metal sealing elements may be used in high-temperature formations, for example, in formations with zones having temperatures equal to or exceeding 350° F. Advantageously, the use of the expandable metal sealing elements of the present disclosure may not be impacted in high-temperature formations. In some examples, the expandable metal sealing elements may be used in both high-temperature formations and with high-salinity fluids. In a specific example, an expandable metal sealing element may be positioned on a conduit and used to form a seal after contact with a brine having a salinity of 10% or greater while also being disposed in a wellbore zone having a temperature equal to or exceeding 350° F.

FIG. 1 is an isometric illustration of a simplified example of an expandable metal sealing element, generally 1. The expandable metal sealing element 1 comprises a composite material of the expandable metal with reinforcement materials distributed therein. The expandable metal forms a matrix and the reinforcement material is distributed within the matrix. The expandable metal sealing element 1 may optionally comprise a bonding agent and/or a removable barrier coating. The expandable metal sealing element 1 is produced as disclosed and described herein and may have any shape as desired. The example of the expandable metal sealing element 1 illustrated by FIG. 1 is a torus-like sealing element having a cylindrical doughnut or ring shape. The expandable metal sealing element 1 comprises an outer diameter 2 and an inner diameter 3. The expandable metal sealing 1 further comprises an outer circumference 4 and an inner circumference 5. A conduit, discussed below, may be inserted through the central opening 6 of the expandable metal sealing element 1 in the axial direction.

Figure 2:
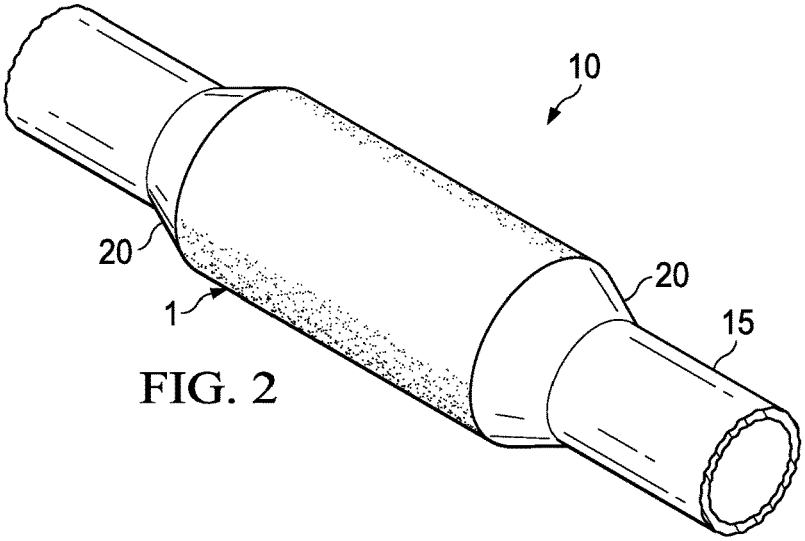
FIG. 2 is an isometric illustration of an example swell packer disposed on a conduit in accordance with the examples disclosed herein.

FIG. 2 is an isometric illustration of an example of a swell packer, generally 10, disposed on a conduit 15. The swell packer 10 comprises an expandable metal sealing element 1 as described in FIG. 1. The swell packer 10 is wrapped or slipped on the conduit 15 with weight, grade, and connection specified by the well design. The conduit 15 may be any type of conduit used in a wellbore, including drill pipe, stick pipe, tubing, coiled tubing, etc.

The swell packer 10 further comprises end rings 20. End rings 20 protect the expandable metal sealing element 1 as it is run to depth. End rings 20 may create an extrusion barrier, preventing the applied pressure from extruding the seal formed from the expandable metal sealing element 1 in the direction of said applied pressure. In some examples, the end rings 20 may also be an expandable metal sealing element 1 or other species of sealing element, and may thus serve a dual function. In some examples, end rings 20 may not be an expandable metal sealing element 1 or other species of sealing element. Although FIG. 2 and some other examples illustrated herein may illustrate end rings 20 as a component of the swell packer 10 or other examples of swell packers, it is to be understood that end rings 20 are optional components in all examples described herein, and are not necessary for any swell packer described herein to function as intended.

When exposed to a reaction-inducing fluid, the expandable metal sealing element 1 may react and produce the expanded metal reaction product described above. As the expanded metal reaction product has a larger volume than the unreacted expendable metal, the expandable metal sealing element 1 is able to expand and form an annular seal at the interface of an adjacent surface (e.g., a wellbore well, conduit, casing, downhole tool, etc.) as described above. The expandable metal sealing element 1 may continue to expand until contact with the adjacent surface is made.

Figure 3:
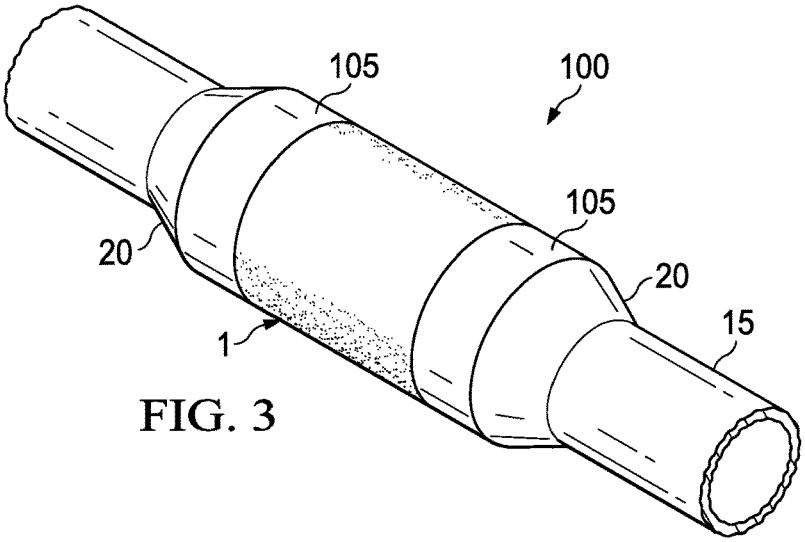
FIG. 3 is an isometric illustration of another example of a swell packer disposed on a conduit in accordance with the examples disclosed herein.

FIG. 3 is an isometric illustration of another example of a swell packer, generally 100, disposed on a conduit 15. The swell packer 100 is wrapped or slipped on the conduit 15 with weight, grade, and connection specified by the well design. The swell packer 100 comprises the expandable metal sealing element 1 and end rings 20 as described in FIG. 2. Swell packer 100 further comprises two non-metal sealing elements 105 disposed adjacent to end rings 20 and the expandable metal sealing element 1.

The non-metal sealing elements 105 may be any species of sealing element. The non-metal sealing elements 105 may comprise any oil-swellable, water-swellable, and/or combination of swellable non-metal material as would occur to one of ordinary skill in the art. A specific example of a swellable non-metal material is a swellable elastomer. The swellable non-metal sealing elements 105 may swell when exposed to a swell-inducing fluid (e.g., an oleaginous or aqueous fluid). Generally, the non-metal sealing elements 105 may swell through diffusion whereby the swell-inducing fluid is absorbed into the structure of the non-metal sealing elements 105 where a portion of the swell-inducing fluid may be retained. The swell-inducing fluid may continue to diffuse into the swellable non-metal sealing elements 105 causing the non-metal sealing elements 105 to swell until they contact an adjacent surface. The non-metal sealing elements 105 may work in tandem with the expandable metal sealing element 1 to create a differential annular seal.

FIG. 3 illustrates two non-metal sealing elements 105. However, it is to be understood that in some examples only one non-metal sealing element 105 may be provided, and the expandable metal sealing element 1 may be disposed adjacent to an end ring 20, or may comprise the end of the swell packer 100 should end rings 20 not be provided. FIG. 3 also illustrates two non-metal sealing elements 105 individually adjacent to one of the terminal ends of the expandable metal sealing element 1. However, it is to be understood that in some examples, this orientation may be reversed and the swell packer 100 may instead comprise two expandable metal sealing elements 1 each individually disposed adjacent to an end ring 20 (if provided) and also one terminal end of a non-metal sealing element 105 that is disposed centrally in swell packer 100.

Figure 4:
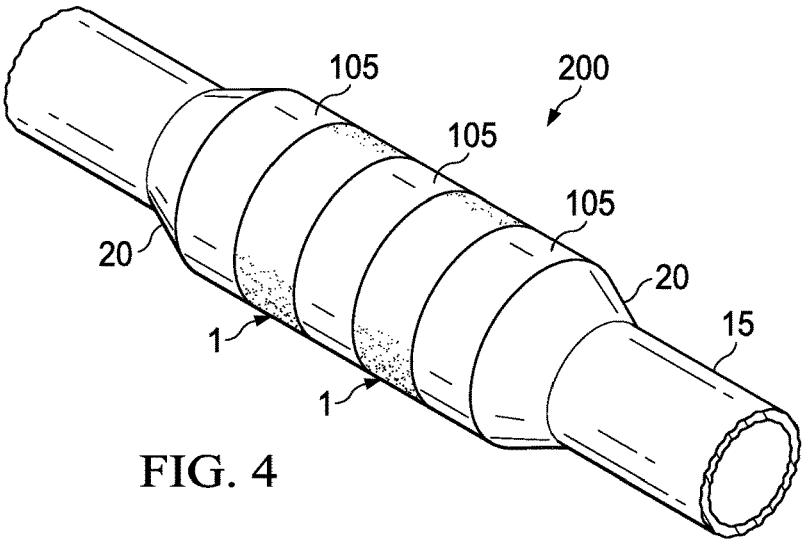
FIG. 4 is an isometric illustration of an additional example of a swell packer disposed on a conduit in accordance with the examples disclosed herein.

FIG. 4 is an isometric illustration of another example of a swell packer, generally 200, disposed on a conduit 15. The swell packer 200 comprises multiple expandable metal sealing elements 1 and also multiple non-metal sealing elements 105. The swell packer 200 is wrapped or slipped on the conduit 15 with weight, grade, and connection specified by the well design. The swell packer 200 further comprises optional end rings 20 as described in FIG. 2. Swell packer 200 differs from swell packer 10 and swell packer 100 as described in FIGS. 2 and 3 respectively in that swell packer 200 alternates the expandable metal sealing elements 1 and the non-metal sealing elements 105. The swell packer 200 may comprise any multiple of expandable metal sealing elements 1 and non-metal sealing elements 105 arranged in any pattern (e.g., alternating as illustrated). The multiple expandable metal sealing elements 1 and non-metal sealing elements 105 may expand or swell as desired to create an annular seal as described above. In some examples, the expandable metal sealing elements 1 may comprise different types of expandable metals and/or reinforcement materials, allowing the swell packer 200 to be custom configured to the well as desired.

Figure 5:
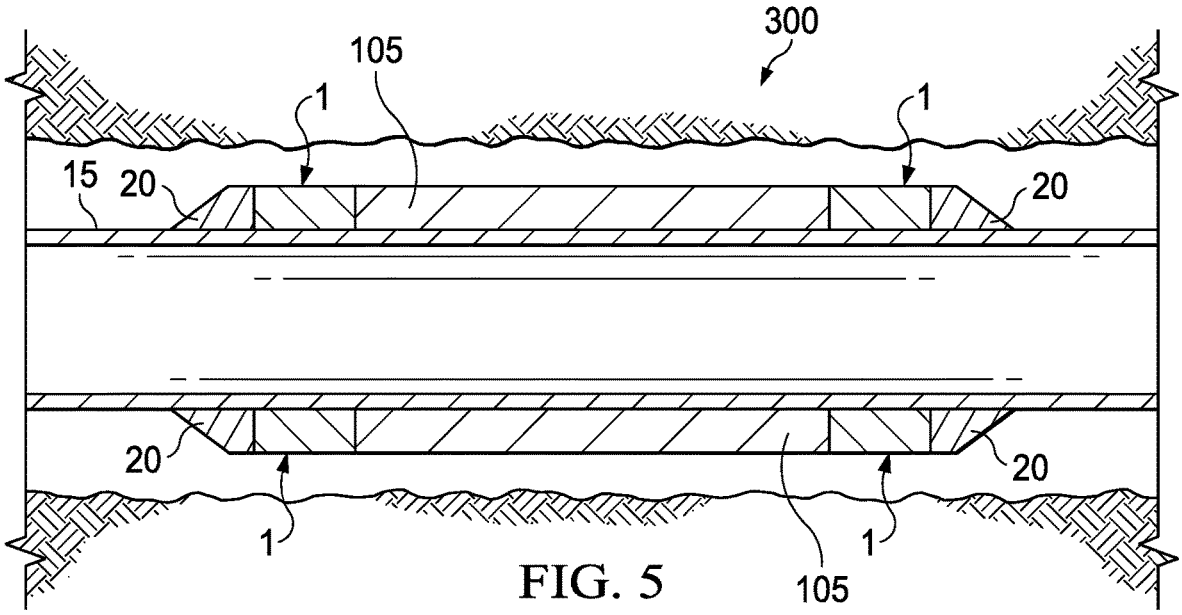
FIG. 5 is a cross-sectional illustration of another example of a swell packer disposed on a conduit in a wellbore in accordance with the examples disclosed herein.

FIG. 5 is a cross-section illustration of another example of a swell packer, generally 300, disposed on a conduit 15. The swell packer 300 comprises an alternative arrangement of multiple expandable metal sealing elements 1 and a non-metal sealing element 105. In this example, swell packer 300 comprises two expandable metal sealing elements 1 individually disposed adjacent to both an end ring 20 and a terminal end of the non-metal sealing element 105. Optional end rings 20 may protect the swell packer 300 from abrasion as it is run in hole.

Figure 6:
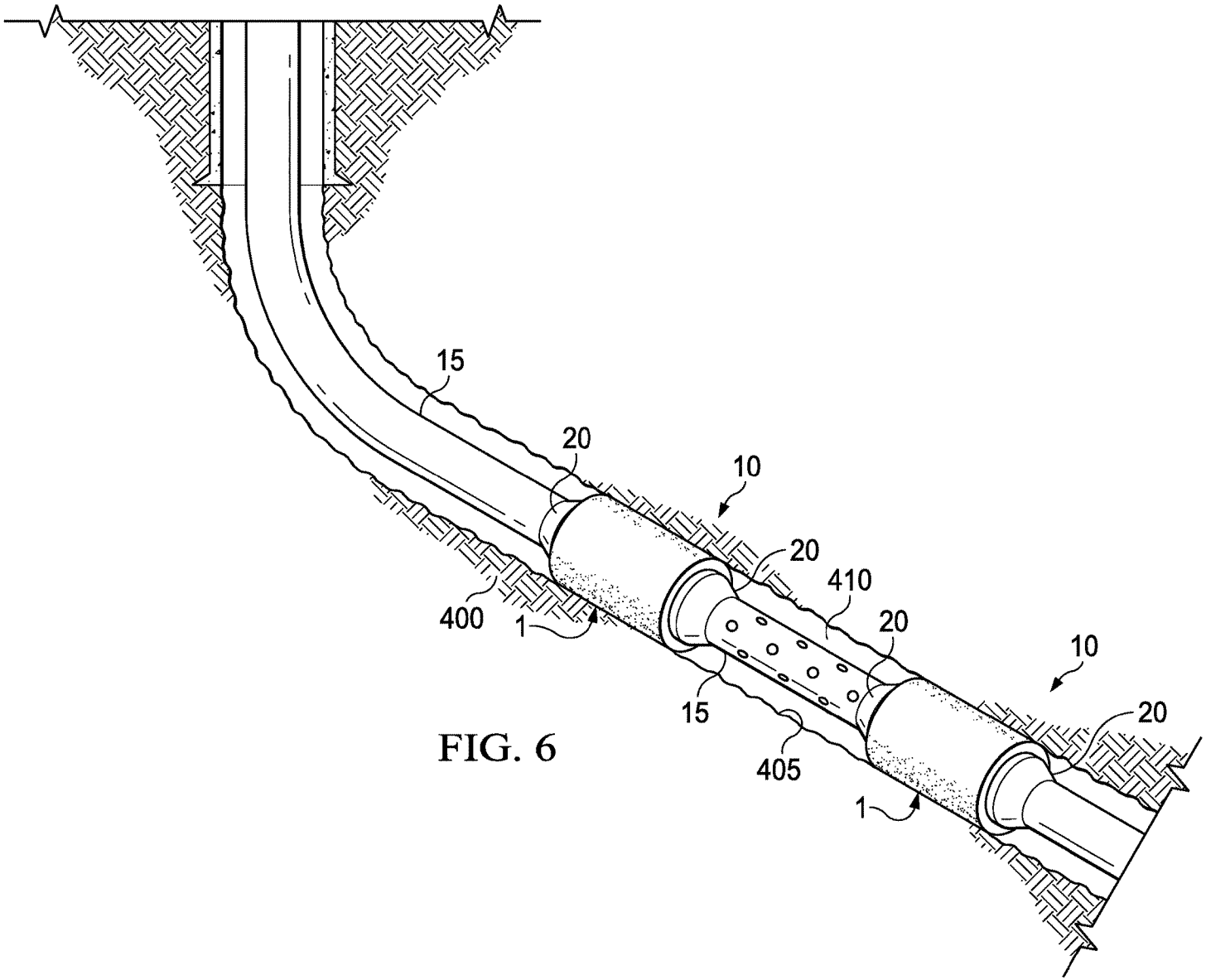
FIG. 6 is an isometric illustration of the swell packer of FIG. 2 disposed on a conduit in a wellbore and set at depth in accordance with the examples disclosed herein.

FIG. 6 illustrates swell packer 10 as described in FIG. 2, when run to a desired depth and set in a subterranean formation 400. At the desired setting depth and when ready for sealing, swell packer 10 is exposed to a reaction-inducing fluid, and the expandable metal sealing element 1 expands to contact the adjacent wellbore wall 405 to form an annular seal as illustrated. In this illustrated example, multiple swell packers 10 are used. As the multiple swell packers 10 seal the wellbore zone, the portion of the wellbore 410 between the formed seals is isolated from the other portions of the wellbore 410 which are not sealed by swell packers 10. Although the isolated portion of wellbore 410 is illustrated as uncased, it is to be understood that the swell packers 10 may be used in any cased portion of wellbore 410 to form an annular seal, for example, in the annulus between the conduit 15 and a cement sheath. Further, swell packers 10 may also be used to form an annular seal between two conduits 15 in other examples. Although FIG. 6 illustrates the use of swell packer 10, it is to be understood that any example of a swell packer or combination of swell packers disclosed herein may be used in any of the examples disclosed herein.

Figure 7:
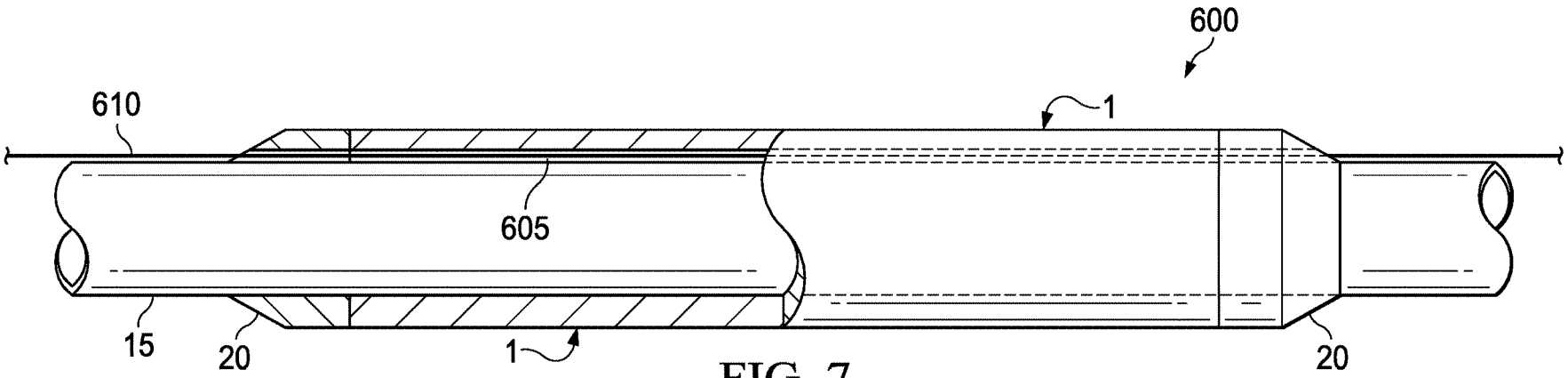
FIG. 7 is a cross-sectional illustration of an additional example of a swell packer disposed on a conduit in accordance with the examples disclosed herein.

FIG. 7 is a cross-sectional illustration of another example of a swell packer, generally 600, disposed on a conduit 15. The swell packer 600 comprises an expandable metal sealing element 1 as described above. The swell packer 600 is wrapped or slipped on the conduit 15 with weight, grade, and connection specified by the well design. The swell packer 600 further comprises optional end rings 20 as described in FIG. 2. In the example of swell packer 600, the expandable metal sealing element 1 surrounds a gap 605 disposed between the expandable metal sealing element 1 and the conduit 15. Within the gap 605, a line 610 may be run. Line 610 may be run from the surface and down the exterior of the conduit 15. Line 610 may be a control line, power line, hydraulic line, or more generally, a conveyance line that may convey power, data, instructions, pressure, fluids, etc. from the surface to a location within a wellbore. Line 610 may be used to power a downhole tool, control a downhole tool, provide instructions to a downhole tool, obtain wellbore environment measurements, inject a fluid, etc. When the expandable metal sealing element 1 is induced to expand by contact with a reaction-inducing fluid, the expandable metal sealing element 1 expands and closes the gap 605 around the line 610, sealing gap 605 and allowing an annular seal to be produced. The expandable metal sealing element 1 seals around line 610 such that line 610 still functions and successfully spans the swell packer 600 even after expansion and sealing is performed.

Figure 8:
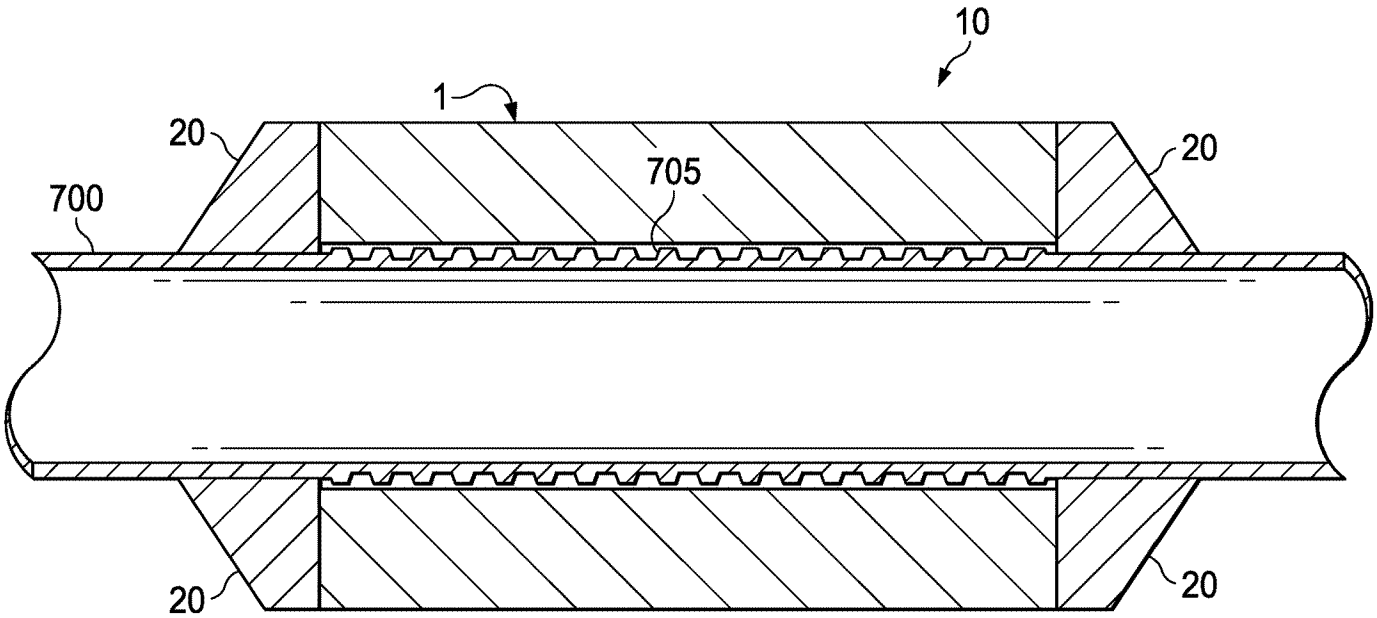
FIG. 8 is a cross-sectional illustration of another example of a swell packer disposed on a conduit in accordance with the examples disclosed herein.

FIG. 8 is a cross-section illustration of a swell packer 10 as described in FIG. 2 around a conduit 700. The swell packer 10 is wrapped or slipped on the conduit 700 with weight, grade, and connection specified by the well design. The conduit 700 comprises a profile variance, specifically, ridges 705 on a portion its exterior surface. The swell packer 10 is disposed over the ridges 705. As the expandable metal sealing element 1 is expanded, it may be extruded into the void spaces or valleys of the ridges 705 allowing the expandable metal sealing element 1 to be even further compressed when a differential pressure is applied. In addition to, or as a substitute for ridges 705, the profile variance on the exterior surface of the conduit 700 may comprise threads, tapering, slotted gaps, or any such variance allowing for the expandable metal sealing element 1 to expand within an interior space on the exterior surface of the conduit 700. Due to the nature of the expandable metal sealing element's 1 expansion capability, the expandable metal sealing element 1 may expand to seal around any profile variance of the conduit or adjacent surface. Additionally, the expandable metal sealing element 1 may be used to seal surfaces with rough finishes or defects. Although FIG. 8 illustrates the use of swell packer 10, it is to be understood that any swell packer or combination of swell packers may be used in any of the examples disclosed herein.

Figure 9:
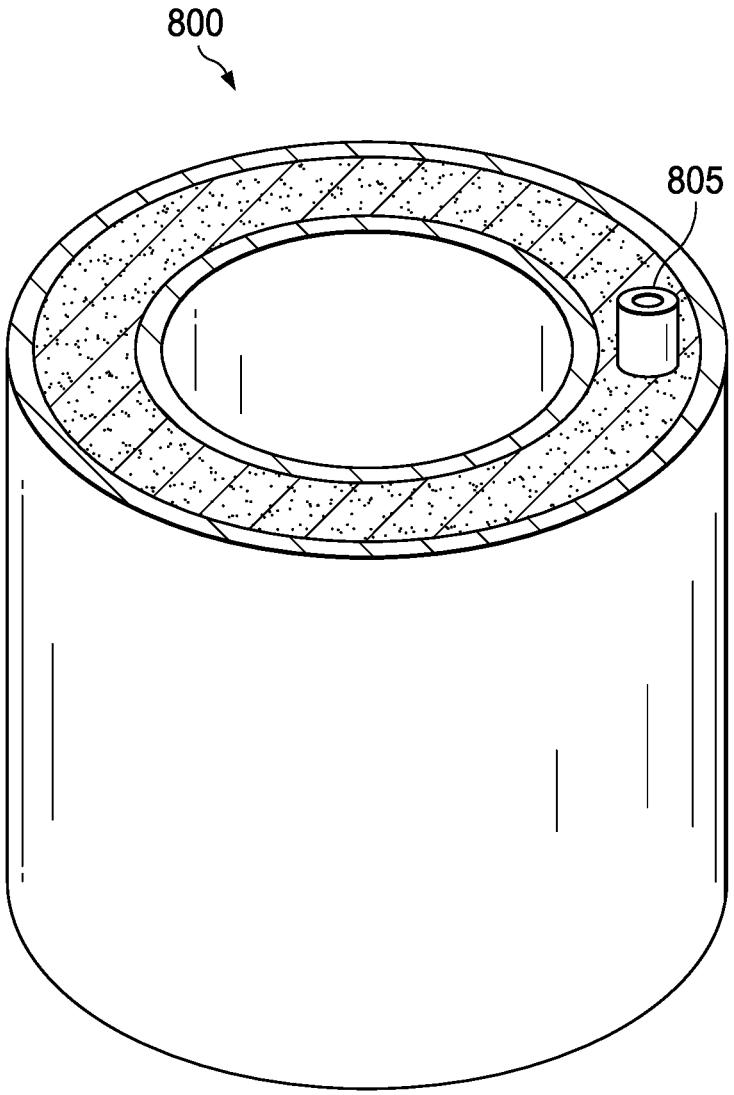
FIG. 9 is an isometric illustration of an example mold used to manufacture an expandable metal sealing element in accordance with the examples disclosed herein.

FIG. 9 is an isometric illustration of half of a compressible mold 800. Discrete pieces of expandable metal and reinforcement materials may be placed in the mold 800 as desired and then compacted to form an expandable metal sealing element (as described above). In mold 800 a hollow tube 805 has been placed. The hollow tube 805 is disposed in mold 800 in a manner that it will not contain the discrete pieces of expandable metal and reinforcement materials. Hollow tube 805 comprises a material which will not crush upon compaction of the discrete pieces of expandable metal and reinforcement materials in the mold 800. The composite material produced from compaction of the discrete pieces of expandable metal and reinforcement materials may be molded around hollow tube 805. Hollow tube 805 may comprise a fitting, placed either before or after compaction, which may be used to couple lines or components on either side of the formed expandable metal sealing element when it is expanded to form a seal. Hollow tube 805 may function as a feed-through for control lines, power lines, hydraulic line, or more generally, conveyance lines that may convey power, data, instructions, pressure, fluids, etc. from the surface to a location within a wellbore.

In an alternative example, mold 800 may comprise an opening analogous to hollow tube 800 that runs through the depth of the mold 800. In this example, the discrete pieces of expandable metal and reinforcement materials will be placed in the mold 800 and be molded around this opening such that the formed expandable metal sealing element comprises discrete openings for a conduit and for a feed-through.

Figure 10:
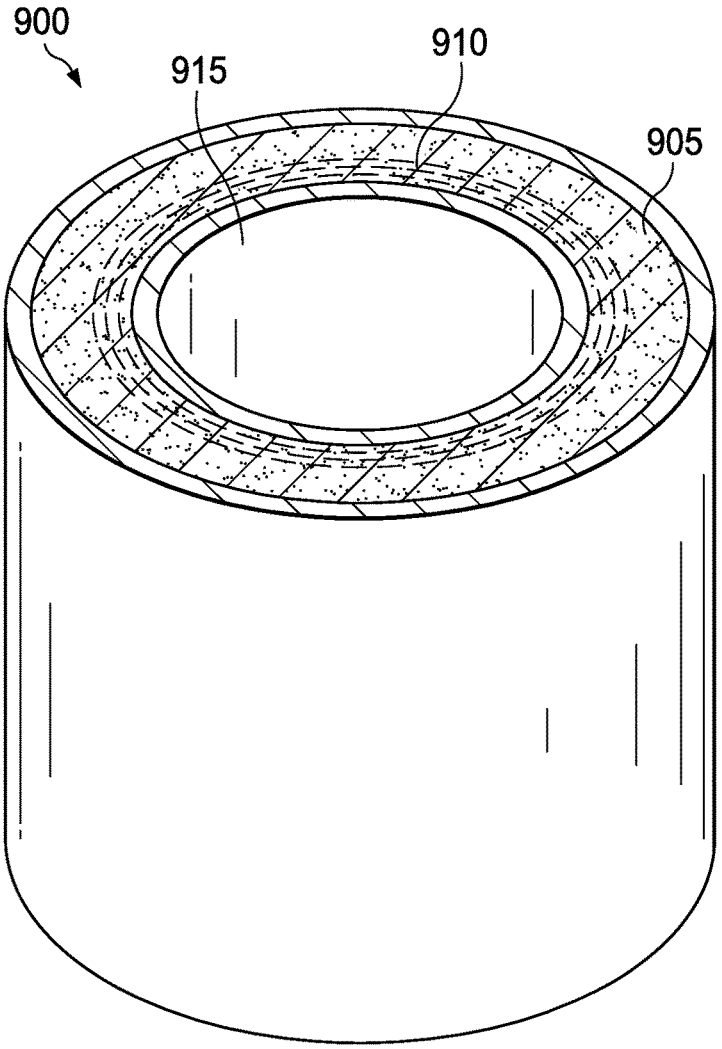
FIG. 10 is an isometric illustration of another example of a mold used to manufacture an expandable metal sealing element in accordance with the examples disclosed herein.

FIG. 10 is an isometric illustration of half of a compressible mold 900. Discrete pieces of expandable metal 905, represented by the cross-hatching, have been placed throughout mold 900. Reinforcement materials 910, represented by the dashed lines, have been distributed only on the interior of the mold 900 towards the axis and around the central opening 915. When the discrete pieces of expandable metal 905 and reinforcement materials 910 are compacted, the composite material will only have the reinforcement materials 910 disposed within the expandable metal 905 matrix at the interior of the formed expandable metal sealing element. This arrangement allows for configuring the expandable metal sealing element to possess increased tensile capability only in a desired portion of the expandable metal sealing element. The reinforcement materials 910 may be unevenly distributed in the expandable metal sealing element in any manner and position as desired. Alternatively, the reinforcement materials 910 may be evenly distributed in the expandable metal sealing element by arranging the reinforcement materials 910 in an even placement in the mold 900, or by dry blending the reinforcement materials 910 with the discrete pieces of expandable metal 905 prior to placement in the mold 900.

Figure 11:
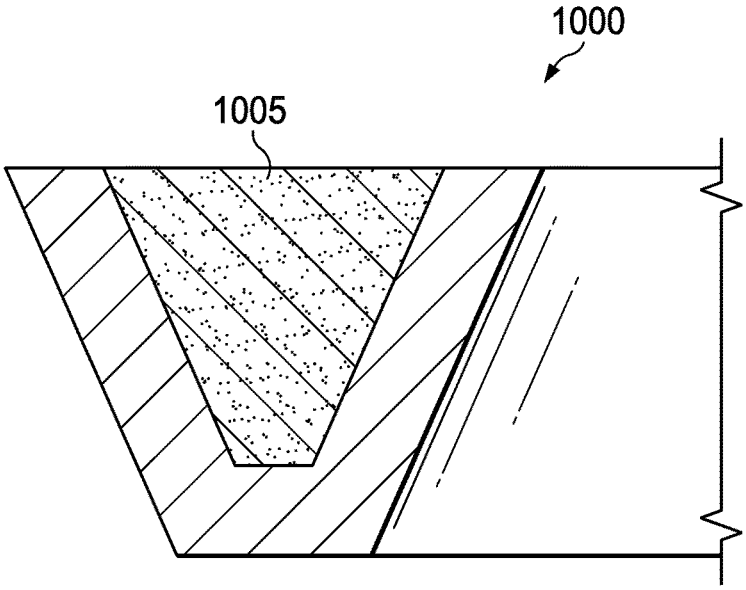
FIG. 11 is a cross-sectional illustration of an example v-ring expandable metal sealing element in accordance with the examples disclosed herein.

FIG. 11 is an illustration of a cross-section through a v-ring sealing element, generally 1000. The v-ring sealing element 1000 may be donut or ring-shaped. The v-ring sealing element may also comprise a v-shaped notch 1005 which may allow for stacking of a series of v-ring sealing elements 1000. The v-ring sealing element 1000 comprises the composite material of the expandable metal with the reinforcement materials distributed therein. The expandable metal forms a matrix and the reinforcement material is distributed within the matrix. The v-ring sealing element 1000 may be stacked in a seal stack with other expandable metal v-ring sealing elements 1000 or with non-metal v-ring sealing elements in any desired configuration.

It should be clearly understood that the examples illustrated by FIGS. 1-11 are merely general applications of the principles of this disclosure in practice, and a wide variety of other examples are possible. Therefore, the scope of this disclosure is not limited in any manner to the details of any of the FIGURES described herein.

It is also to be recognized that the disclosed sealing elements may also directly or indirectly affect the various downhole equipment and tools that may come into contact with the sealing elements during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in any of the FIGURES.

Provided are expandable metal sealing elements for forming a seal in a wellbore in accordance with the disclosure and the illustrated FIGURES. An example expandable metal sealing elements comprises a composite material of expandable metal and a reinforcement material. The expandable metal forms a matrix and the reinforcement material is distributed within the matrix.

Additionally or alternatively, the expandable metal sealing element may include one or more of the following features individually or in combination. The expandable metal may comprise a metal selected from the group consisting of magnesium, calcium, aluminum, and any combination thereof. The expandable metal may comprise a metal alloy selected from the group consisting of magnesium-zinc, magnesium-aluminum, calcium-magnesium, aluminum-copper, and any combination thereof. The reinforcement material may comprise a material selected from the group consisting of metals, ceramics, glass, plastics, and any combination thereof. The reinforcement material may comprise a shape selected from the group consisting of a rod, a ball, a mesh, and any combination thereof. The expandable metal sealing element may further comprise a bonding agent. The expandable metal sealing element may further comprise a removable barrier coating. The expandable metal sealing element may further comprise a feed-through. The expandable metal sealing element may be disposed on a conduit. The conduit may comprise a profile variance on its exterior surface and the expandable metal sealing element may be positioned over the profile variance. The expandable metal sealing element may be a component of a swell packer. The swell packer may further comprise a swellable non-metal sealing element. The expandable metal sealing element may be produced by compaction of discrete pieces of the expandable metal with the reinforcement material in a mold.

Provided are methods for forming a seal in a wellbore in accordance with the disclosure and the illustrated FIGURES. An example method comprises positioning an expandable metal sealing element in the wellbore; wherein the expandable metal sealing element comprises: An example expandable metal sealing element comprises a composite material of expandable metal and a reinforcement material. The expandable metal forms a matrix and the reinforcement material is distributed within the matrix. The method further comprises contacting the expandable metal sealing element with a fluid that reacts with the expandable metal to produce a reaction product having a volume greater than the expandable metal.

Additionally or alternatively, the method may include one or more of the following features individually or in combination. The expandable metal may comprise a metal selected from the group consisting of magnesium, calcium, aluminum, and any combination thereof.

The expandable metal may comprise a metal alloy selected from the group consisting of magnesium-zinc, magnesium-aluminum, calcium-magnesium, aluminum-copper, and any combination thereof. The reinforcement material may comprise a material selected from the group consisting of metals, ceramics, glass, plastics, and any combination thereof. The reinforcement material may comprise a shape selected from the group consisting of a rod, a ball, a mesh, and any combination thereof. The expandable metal sealing element may further comprise a bonding agent. The expandable metal sealing element may further comprise a removable barrier coating. The expandable metal sealing element may further comprise a feed-through. The expandable metal sealing element may be disposed on a conduit. The conduit may comprise a profile variance on its exterior surface and the expandable metal sealing element may be positioned over the profile variance. The expandable metal sealing element may be a component of a swell packer. The swell packer may further comprise a swellable non-metal sealing element. The expandable metal sealing element may be produced by compaction of discrete pieces of the expandable metal with the reinforcement material in a mold.

Provided are systems for forming a seal in a wellbore in accordance with the disclosure and the illustrated FIGURES. An example system comprises an expandable metal sealing element comprising a composite material of expandable metal and a reinforcement material. The expandable metal forms a matrix and the reinforcement material is distributed within the matrix. The system further comprises a conduit with the expandable metal sealing element disposed thereon.

Additionally or alternatively, the system may include one or more of the following features individually or in combination. The expandable metal may comprise a metal selected from the group consisting of magnesium, calcium, aluminum, and any combination thereof. The expandable metal may comprise a metal alloy selected from the group consisting of magnesium-zinc, magnesium-aluminum, calcium-magnesium, aluminum-copper, and any combination thereof. The reinforcement material may comprise a material selected from the group consisting of metals, ceramics, glass, plastics, and any combination thereof. The reinforcement material may comprise a shape selected from the group consisting of a rod, a ball, a mesh, and any combination thereof. The expandable metal sealing element may further comprise a bonding agent. The expandable metal sealing element may further comprise a removable barrier coating. The expandable metal sealing element may further comprise a feed-through. The expandable metal sealing element may be disposed on a conduit. The conduit may comprise a profile variance on its exterior surface and the expandable metal sealing element may be positioned over the profile variance. The expandable metal sealing element may be a component of a swell packer. The swell packer may further comprise a swellable non-metal sealing element. The expandable metal sealing element may be produced by compaction of discrete pieces of the expandable metal with the reinforcement material in a mold.

The preceding description provides various examples of the apparatus, systems, and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for forming a seal in a wellbore comprising:
positioning an expandable metal sealing element in the wellbore; wherein the expandable metal sealing element comprises:
a composite material comprising an expandable metal and a reinforcement material; wherein the expandable metal forms a matrix and the reinforcement material is distributed within the matrix;
contacting the expandable metal sealing element with a fluid that reacts with the expandable metal to produce a metal hydroxide reaction product having a volume greater than the expandable metal; and
forming a seal with the reaction product.

2. The method of claim 1, wherein the expandable metal comprises a metal selected from the group consisting of magnesium, calcium, aluminum, and any combination thereof.

3. The method of claim 1, wherein the expandable metal comprises a metal alloy selected from the group consisting of magnesium-zinc, magnesium-aluminum, calcium-magnesium, aluminum-copper, and any combination thereof.

4. The method of claim 1, wherein the reinforcement material comprises a material selected from the group consisting of metals, ceramics, glass, plastics, and any combination thereof.

5. The method of claim 1, wherein the reinforcement material comprises a shape selected from the group consisting of a rod, a ball, a mesh, and any combination thereof.

6. The method of claim 1, wherein the expandable metal sealing element further comprises a bonding agent.

7. The method of claim 1, wherein the expandable metal sealing element further comprises a removable barrier coating.

8. The method of claim 1, wherein the expandable metal sealing element further comprises a feed-through.

9. The method of claim 1, wherein the expandable metal sealing element is disposed on a conduit.

10. The method of claim 9, wherein the conduit comprises a profile variance on its exterior surface; wherein the expandable metal sealing element is positioned over the profile variance.

11. The method of claim 1, wherein the expandable metal sealing element is a component of a swell packer.

12. The method of claim 11, wherein the swell packer further comprises a swellable non-metal sealing element.

13. The method of claim 1, wherein the expandable metal sealing element was produced by compaction of discrete pieces of the expandable metal with the reinforcement material in a mold.

14. An expandable metal sealing element for forming a seal, the expandable metal sealing element comprising:
a composite material comprising an expandable metal and a reinforcement material; wherein the expandable metal forms a matrix and the reinforcement material is distributed within the matrix; wherein the expandable metal is a reactive metal that reacts with a fluid to form a metal hydroxide reaction product; wherein the reaction product is configured to form the seal.

15. The expandable metal sealing element of claim 14, wherein the expandable metal comprises a metal selected from the group consisting of magnesium, calcium, aluminum, and any combination thereof.

16. The expandable metal sealing element of claim 14, wherein the reinforcement material comprises a material selected from the group consisting of metals, ceramics, glass, plastics, and any combination thereof.

17. The expandable metal sealing element of claim 14, wherein the expandable metal sealing element further comprises a bonding agent.

18. A system for forming a seal in a wellbore:

an expandable metal sealing element comprising:

a composite material comprising an expandable metal and a reinforcement material; wherein the expandable metal forms a matrix and the reinforcement material is distributed within the matrix; wherein the expandable metal is a reactive metal that reacts with a fluid to form a metal hydroxide reaction product; wherein the reaction product is configured to form the seal; and a conduit with the expandable metal sealing element disposed thereon.

19. The system of claim 18, wherein the expandable metal sealing element is a component of a swell packer.

20. The system of claim 18, wherein the conduit comprises a profile variance on its exterior surface; wherein the expandable metal sealing element is positioned over the profile variance.

* * * * *